US005706676A

United States Patent [19]

Ossensi

[11] Patent Number: 5,706,676

[45] Date of Patent: Jan. 13, 1998

[54] PNEUMATIC THREAD FEEDER IN KNITTING MACHINES OR THE LIKE

[75] Inventor: Severino Ossensi, Viggiu' , Italy

[73] Assignee: MEC-MOR S.p.A., Induno Olona, Italy

[21] Appl. No.: 678,877

[22] Filed: Jul. 12, 1996

[30] Foreign Application Priority Data

Jul. 20, 1995 [IT] Italy ..... MI95A1570

[51] Int. Cl.[6] ..... D04B 15/60

[52] U.S. Cl. ..... 66/125 R; 66/132 R; 242/147 A

[58] Field of Search ..... 242/147 A; 66/125 R, 66/132 R, 140 R

[56] References Cited

U.S. PATENT DOCUMENTS

| | | | |
|---|---|---|---|
| 3,134,248 | 5/1964 | Kubelka et al. | 66/125 R |
| 3,511,064 | 5/1970 | Major et al. | 66/125 R |
| 3,813,900 | 6/1974 | Cook et al. | 66/125 R |
| 3,890,809 | 6/1975 | Tenconi | 66/132 R |
| 3,955,379 | 5/1976 | Cobiere | 66/132 R X |
| 4,137,732 | 2/1979 | Gostelow et al. | 66/125 R X |
| 4,193,274 | 3/1980 | Gostelow | 66/140 R |
| 4,285,285 | 8/1981 | Chambers et al. | 66/132 R X |

FOREIGN PATENT DOCUMENTS 27 39 412 3/1978 Germany .

*Primary Examiner*—John J. Calvert

*Attorney, Agent, or Firm*—Guido Modiano; Albert Josif; Daniel J. O'Byrne

[57] ABSTRACT

A pneumatic thread feeder in knitting machines or the like having at least one tube in which a passage is provided having an outlet to be directed towards the needle work region of a knitting machine; injection means for injecting air through the tube; means for actuating the injection means; and abutments that form a path for the approach of the thread to the inlet of the tube. The tube is served by a thread takeup element that is arc-shaped and is pivoted to a supporting structure about an axis located on the concave side of the body of the takeup element. The takeup element has, proximate to one of its ends, a passage for the thread, and is arranged so as to move transversely with respect to a portion of the path for the approach of the thread to the tube when it is turned about the axis. Actuation means act on the takeup element and cause its oscillation about the axis from a working position, in which its thread passage is located proximate to the path for the approach of the thread to the tube, to a takeup position, in which its thread passage is moved away from the approach path so as to lengthen the path followed by the thread, producing takeup of the thread inside the tube as a consequence of the clamping of the thread performed upstream of the takeup element.

15 Claims, 3 Drawing Sheets

PNEUMATIC THREAD FEEDER IN KNITTING MACHINES OR THE LIKE

BACKGROUND OF THE INVENTION

The present invention relates to a pneumatic thread feeder for knitting machines or the like.

In conventional knitting machines the threads for forming the knitted fabric are fed to the various needles of the machine by appropriate elements, termed thread guides, which have the purpose of feeding the thread to the needles, which move with respect to the thread guides, in such a position as to ensure that the needles engage the thread, or as to move the thread, if it must not be knitted, into a position in which the hook of the needle cannot engage it. A knitting machine generally has a plurality of thread guides at each thread feed, so as to allow to feed the needles with different threads according to the knitting and/or patterns to be formed.

Knitting machines have long used pneumatic thread guides, i.e., thread guides that are substantially constituted by a tube inside which a jet of compressed air is delivered which has the purpose of conveying inside the tube the thread to be fed to the needles of the machine so as to keep it correctly orientated with respect to the needles of the machine to achieve safe engagement of the thread on the part of the needles.

These pneumatic thread guides are generally also provided with a thread takeup element having the purpose of making the thread retract inside the tube if the thread must not take part in the knitting in progress, thus preventing the various non-knit threads from becoming tangled one another, or preventing interference of the thread with the needles or with other elements of the machine that might lead to errors in knitting or to interruptions in said knitting.

In these pneumatic thread guides, the thread takeup element is generally arranged proximate to the inlet of the tube and is movable, by oscillating about an axis or by virtue of a simple translatory motion, in a direction lying transversely to the direction followed by the thread along a portion of the path followed by the thread in its approach to the tube, so that the movement of the takeup element, engaged with the thread, changes the length of the path followed by the thread and therefore causes its takeup inside the tube or its exit from the outlet of said tube.

Italian Patent no. 1,244,604 discloses a pneumatic device in which the takeup element is movable transversely to the direction followed by the thread proximate to the inlet of the tube inside a chamber supplied with compressed air that has the function of entraining the thread introduced in the tube and of moving the takeup element into the position that corresponds to the working position, i.e., to the position in which the thread is fed to the needles of the knitting machine. This device has the advantage of considerably simplifying the operation for inserting the thread in the device and of having an extremely compact structure with limited bulk.

However, the use of this device has shown that there are drawbacks that are mainly linked to an accumulation of the thread in the sliding chamber of the takeup element during the transfer of said takeup element from the takeup position to the working position.

Said accumulation of thread can lead to an interruption in thread feeding and therefore to an interruption of the production cycle of the knitting machine, requiring the intervention of an operator to restore the correct feeding of the machine.

SUMMARY OF THE INVENTION

A principal aim of the present invention is to solve the above-described problem by providing a pneumatic thread feeding device in knitting machines or the like having high operating reliability.

Within the scope of this aim, an object of the invention is to provide a device having an extremely compact structure with limited bulk.

Another object of the invention is to provide a device that can be used on a wide range of knitting machines.

This aim, these objects, and others which will become apparent hereinafter are achieved by a pneumatic thread feeder in knitting machines or the like, which comprises: at least one tube in which a passage is provided having an outlet to be directed towards the needle work region of a knitting machine; injection means for injecting air through said tube; means for actuating said injection means; and abutments that form a path for the approach of the thread to the inlet of said tube; a thread takeup element that can move transversely to at least one portion of said approach path; and thread clamping means arranged upstream of said takeup element along the thread feeding direction; characterized in that said takeup element has an arc-shaped body and is pivoted to a supporting structure about an axis that is located on the concave side of the body of said takeup element, said takeup element having, proximate to one of its ends, a passage for the thread; means being provided for the actuation of said takeup element with an oscillation about said axis from a working position, in which it is arranged so that its thread passage is proximate to said path for the approach of said thread to said tube, to a takeup position, in which its thread passage is moved away from said approach path to lengthen the path followed by the thread, producing takeup of the thread inside said tube.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
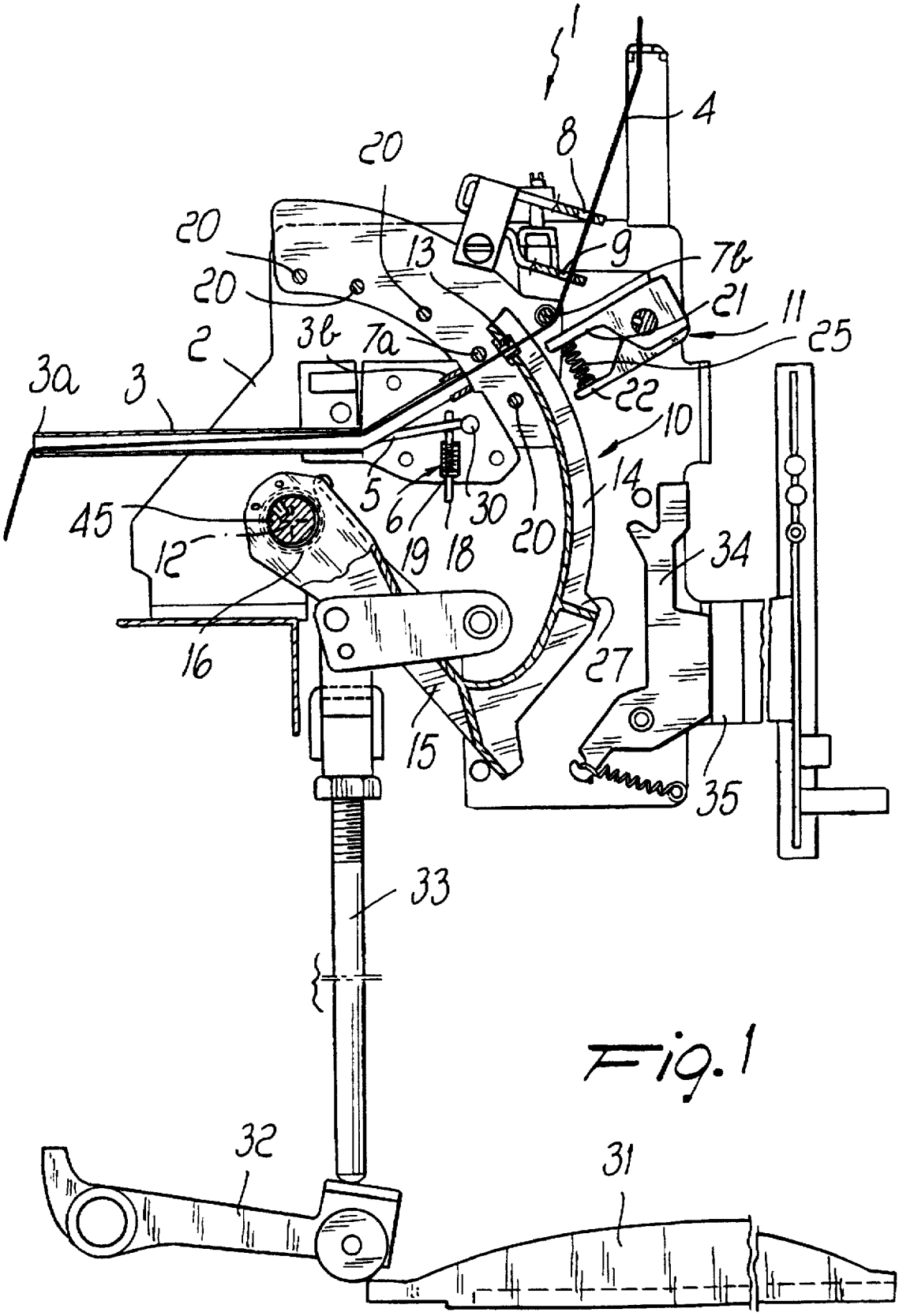
FIG. 1 is a schematic lateral elevation view of the device according to the invention, with the takeup element in working position.

With reference to the above figures, the device according to the invention, generally designated by the reference numeral 1, comprises a supporting structure 2, which is meant to be connected to a knitting machine or the like at a region for feeding the threads to be knitted and supports at least one tube 3 provided with an outlet 3*a* to be directed towards the working region of the needles of the knitting machine.

The device according to the invention furthermore comprises means for injecting air through the tube 3 so as to facilitate the dispensing and orientation, through the outlet 3a, of the thread 4 introduced in the tube 3 through its inlet 3b.

The means for injecting air in the tube 3 can be constituted, for example, by a feeder duct 5 connected to the tube 3 by means of an appropriate valve 6 that can be actuated so as to activate or deactivate the connection of the duct 5 to the tube 3, according to the requirements, as will become apparent hereinafter.

Proximate to the inlet 3b of the tube 3 there are provided abutments that set a path for the approach of the thread 4 to the tube 3. Said abutments comprise at least one pair of pins 7a and 7b whereon the thread 4 rests in its path for approaching the tube 3. Other thread passages, such as for example the passages designated by the reference numerals 8 and 9, can be provided along the path for the approach of the thread 4 to the tube 3.

The device according to the invention also comprises a thread takeup element 10, which is movable transversely with respect to at least one portion of the approach path formed by the pins 7a and 7b and by the passages 8 and 9, and thread clamping means 11 that are arranged upstream of the takeup element 10 along the feeding direction of the thread 4.

According to the invention, the takeup element 10 has a body that is arc-shaped and is pivoted to the supporting structure 2 about an axis 12 that is located on the concave side of the body of the takeup element 10. The takeup element 10 has a passage 13 for the thread 4 proximate to one of its ends, and there are provided means for actuating the takeup element 10 so that it oscillates about the axis 12, in order to make it pass from a working position, in which the takeup element 10 is arranged so that its passage 13 is proximate to the path for the approach of the thread 4 to the tube 3, to a takeup position, in which its passage 13 is moved away from the path for the approach of the thread 4 to the tube 3, so as to lengthen the path followed by the thread, causing takeup of the thread inside the tube 3, as shown schematically in FIG. 2.

More particularly, the body of the takeup element 10 is substantially composed of a portion 14 that is arc-shaped and is provided, proximate to one end, with the passage 13, whereas at the other end it is connected to an arm 15 that is orientated radially with respect to the portion 14 and is pivoted to the supporting structure 2, about the axis 12, with its end lying opposite to the portion 14.

The arm 15 is pivoted about a shaft 45 the axis whereof is the axis 12, and is connected thereto by elastic means, constituted for example by a spring 16, which act on the takeup element 10 so as to keep it in the working position, i.e., in the position shown in FIG. 1.

Figure 2:
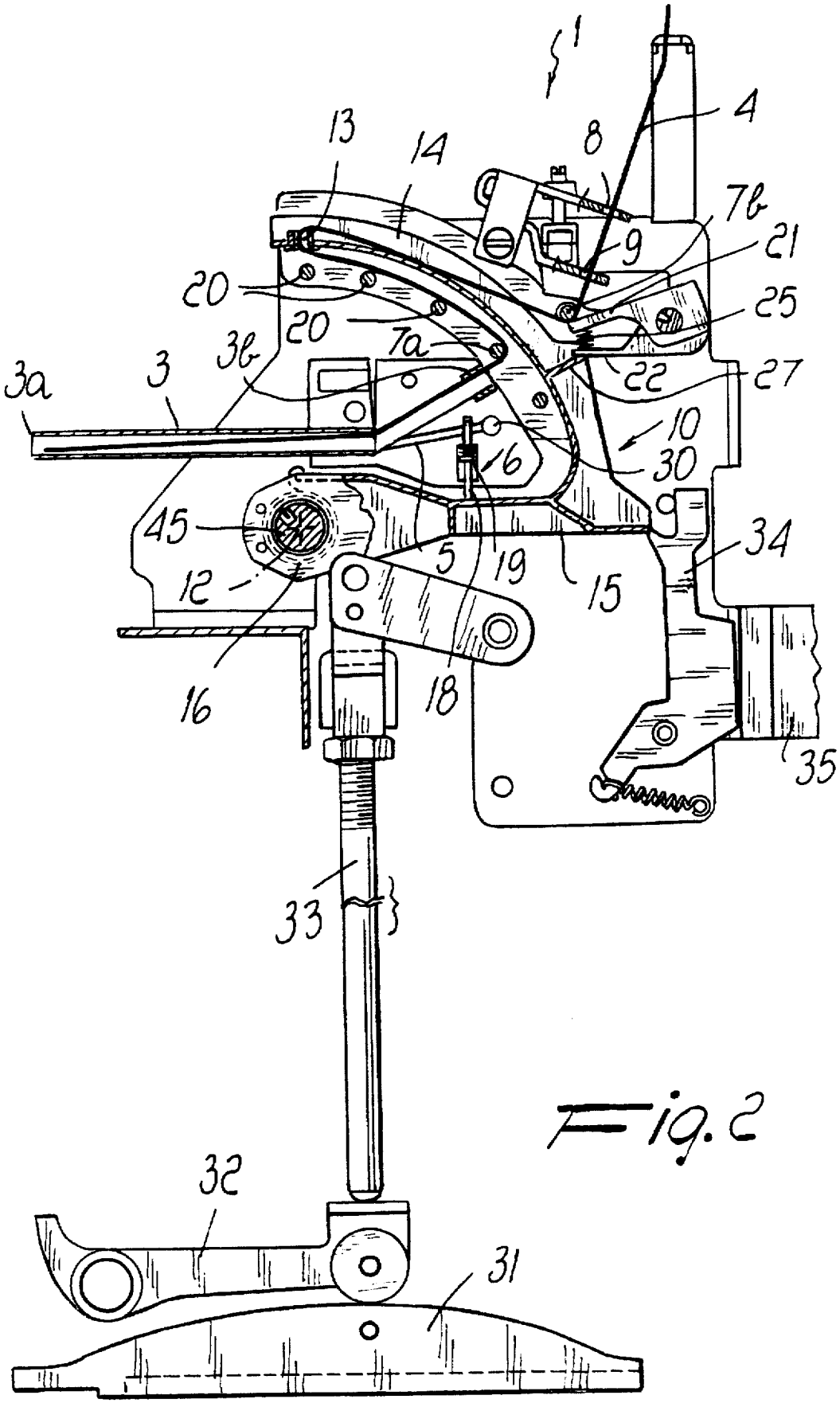
FIG. 2 is a schematic lateral elevation view of the device according to the invention, with the takeup element in takeup position.
Figure 3:
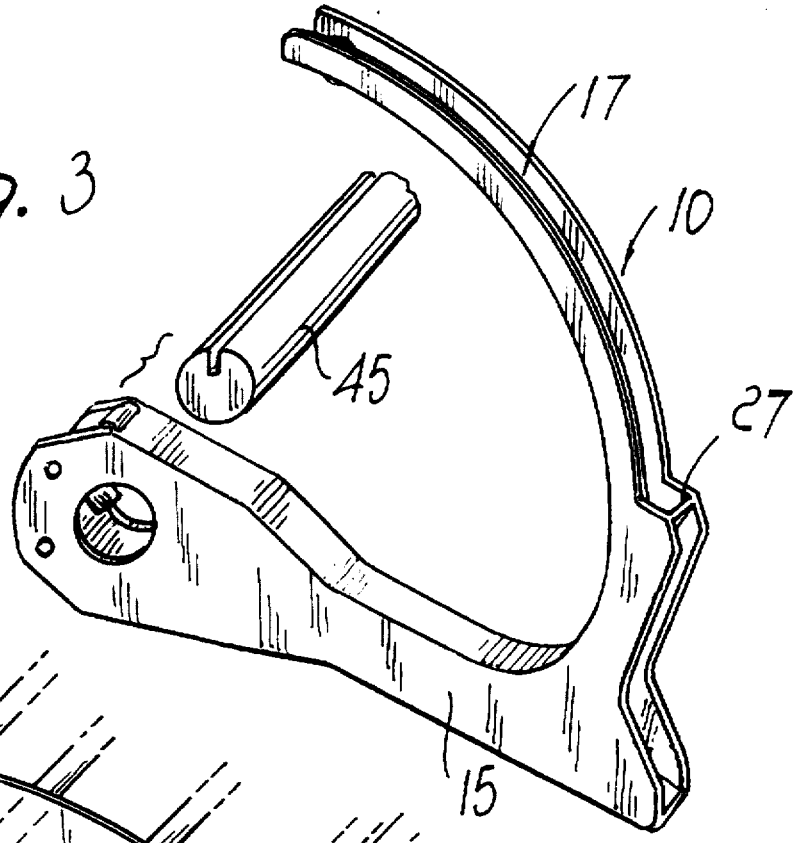
FIG. 3 is an exploded perspective view of the takeup element of the device according to the invention.

Conveniently, the portion 14 of the takeup element 10 has, on its convex side, a channel 17 that is open outwards and is meant to accommodate a portion of the thread 4 when the takeup element 10 is moved into the takeup position, shown in FIG. 2.

The takeup element 10 is arranged between the two pins 7a and 7b so that its oscillation about the axis 12 moves the portion 14 transversely with respect to the portion of the path of the thread 4 that runs between the pins 7a and 7b.

Advantageously, the center of curvature of the portion 14 of the takeup element 10 is located on the axis 12.

The takeup element 10, with its arm 15, interferes, when it is in the takeup position, with the valve 6 that constitutes the actuation means of the injection means. In practice, the valve 6 is constituted by a needle valve the shutter element 18 whereof is pushed by a spring 19 in the open position. The shutter 18 faces the arm 15 of the takeup element 10, which, when moved into the takeup position, engages the shutter 18, moving it to the closure position, in contrast with the action applied by the spring 19.

The supporting structure 2 is provided with a plurality of pins 20 arranged along a curved path that faces the concave side of the portion 14 of the takeup element 10, so as to keep the thread 4 adjacent to the takeup element in the takeup position, as shown in particular in FIG. 2.

The clamping means 11 comprise a presser element, constituted by two arms 21 and 22, one of which faces the pin 7b; said presser element is arranged upstream of the takeup element 10 along the direction in which the thread 4 is fed.

The arm 22 is connected, through a tab 23, to a shaft 24 that can be rotated about its own axis over an arc of preset width. The arm 22 is connected, by means of a spring 25, to the arm 21, which is also supported by the shaft 24. In practice, by turning the shaft 24 about its own axis it is possible to move the arm 21 so that it presses the thread 4 against the pin 7b, braking said thread. The presence of the spring 25 prevents the thread from being subjected to an excessive pressure that could damage it. Furthermore, the tab 23 engages a groove 26 of the shaft 24 the angular extension whereof is adequately greater than the angular extension of the tab 23 about the axis of the shaft 24, so as to allow rotation of the shaft 24 about its own axis without affecting the arms 21 and 22, whereas the arm 21 is kept engaged with the thread 4 by the action applied by said takeup element 10 in the takeup position.

The takeup element 10 in fact has, along the portion 14, a shoulder 27 that makes contact with the arm 22 when the takeup element 10 is moved into the takeup position.

Figure 4:
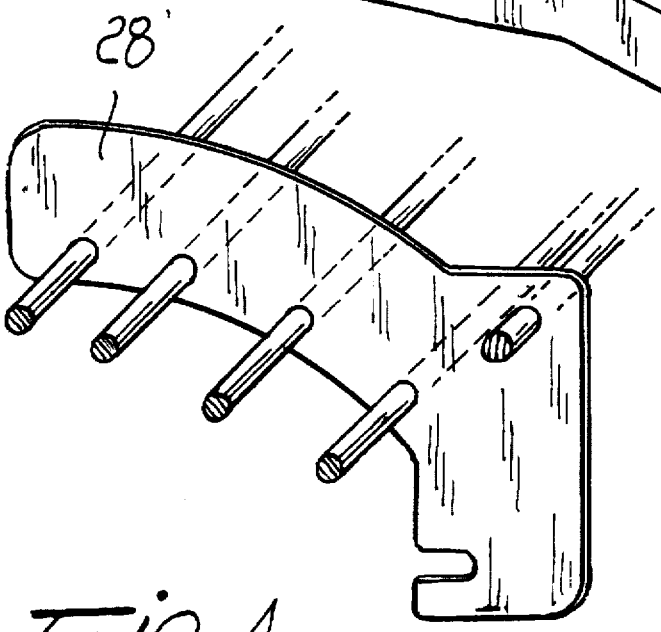
FIG. 4 is a perspective view of a separator of the device according to the invention.
Figure 5:
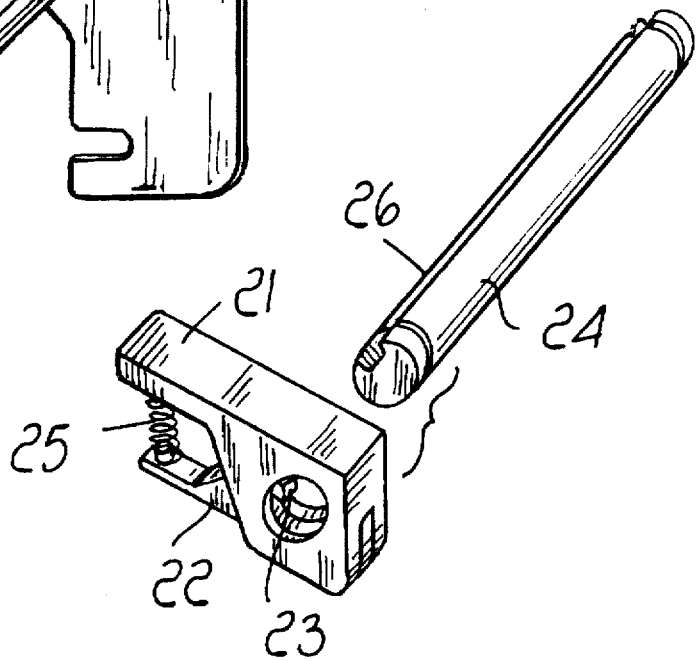
FIG. 5 is an exploded perspective view of the thread clamping means.

The device according to the invention can have a plurality of side-by-side tubes 3, each meant to feed one thread 4 to the knitting machine; each tube 3 will be served by a takeup element 10 of the described and illustrated type. The various takeup elements 10 are arranged side by side, are mounted on a same shaft 45, and are separated by appropriate plate-like separators 28 of the type shown in FIG. 4.

For each tube 3 there are provided means 11 for clamping the thread 4, and each tube 3 is supplied with a jet of compressed air through a respective supply duct 5, which can optionally be connected to a single manifold duct 30.

The means for actuating the various takeup elements 10 comprise first means for the collective actuation of the takeup elements 10, which make them pass from the working position to the takeup position, and second actuation means, which individually retain the takeup elements 10 in the takeup position.

The first means for the actuation of the takeup elements comprises a cam device that causes the simultaneous oscillation of all the takeup elements 10 about the axis 12 to pass from the working position to the takeup position. More particularly, the cam device is substantially composed of a cam 31 that is connected to an element of the knitting machine that moves with respect to the pneumatic device according to the invention and is connected, by means of a cam follower element 32, to a rod 33 acting on the takeup elements 10.

The second actuation means comprise a plurality of levers 34, one for each takeup element 10, which can be engaged and disengaged, for example by means of actuators of the electromagnetic type 35, with respect to the takeup elements 10 so as to retain them or release them in the takeup position.

The operation of the pneumatic thread feeder in knitting machines or the like according to the invention is as follows.

When a thread 4 must be fed to the needles of the knitting machine, the cam 31 performs a sort of reset of the device, which substantially consists in causing, by means of the cam follower 32 and the rod 33, the passage of all the takeup elements 10 from the working position, shown in FIG. 1, to the takeup position, shown in FIG. 2. Prior to the oscillation of the takeup elements 10 about the axis 12 in passing from the working position to the takeup position, the clamping means 11 are activated and, by locking the thread 4 upstream of the takeup elements, produce, by virtue of the action of the takeup elements 10, the takeup of the thread 4 inside the tube 3. Of course, the action of the rod 33 is irrelevant for the takeup elements 10 that are already in the takeup position.

The passage of the takeup elements 10 to the takeup position also entails the interruption of the delivery of the jet of air through the tube 3, as a consequence of the closure of the shutter element 18 performed by said takeup elements 10.

At this point, the electromagnets 35 corresponding to the tubes that must deliver the thread to the needles are activated, whereas the electromagnets corresponding to the tubes that internally accommodate the threads that must not be fed are not activated.

The activation of the electromagnets 35 causes the disengagement of the corresponding levers 34 from the takeup elements 10 which, through the action of the spring 16, are returned to the working position, disengaging the shutter element 18, which opens the duct 5, allowing the flow of air that causes the dispensing of the thread to the needles of the machine. It should be noted that directly after the takeup elements 10 have been moved into the takeup position, the shaft 24, previously actuated so as to clamp all the threads 4, has been turned in the opposite direction, so as to free the clamping means which, however, are kept engaged with the thread 4 by the takeup elements 10 that are kept in the takeup position, whereas they disengage from the thread 4 for the takeup elements 10 that are instead not retained in the takeup position and therefore move into the working position.

The threads 4 that correspond to the takeup elements 10 in working position are correctly fed to the needles of the knitting machine.

Whenever one wishes to change the thread being knitted, or whenever one wishes to interrupt thread feeding, the cycle as described above is repeated, i.e., the clamping means 11 are first activated and then the corresponding takeup elements 10 are moved from the working position to the takeup position to then allow a fresh selection of the threads to be fed to the machine.

It will be clear from the above description that the term "thread" was in fact used as having the meaning of "yarn" which is the technical term more commonly used in the textile industry.

In practice it has been observed that the device according to the invention fully achieves the intended aim, since it provides high reliability in operation that considerably reduces the possibility of jamming or anomalies in operation during use.

Another advantage of the device according to the invention is that it has an extremely compact structure that allows to have, on board the knitting machine, a small space occupation despite a number of thread feeder tubes that is capable of meeting the most disparate knitting or pattern requirements.

The device thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. A pneumatic yarn feeder for knitting machines, comprising: at least one tube in which a passage is provided having an outlet for directing yarn towards a needle work region of the knitting machine; injection means for injecting air through said at least one tube; means for actuating said injection means; and abutments which form a path for the approach of the yarn to an inlet of the tube; a yarn takeup element movable transversely to at least one portion of said approach path; and yarn clamping means arranged upstream in the yarn feeding direction of said takeup element; wherein said yarn takeup element has an arc-shaped body having at least one end, a concave and a converse side and which is pivoted on a supporting structure about an axis that is located on the concave side of the body of the takeup element, said yarn takeup element having, proximate to said at least one end, a passage for the yarn; actuation means for oscillation of said yarn takeup element about said axis from a working position, in which the take up element is arranged so that the yarn passage is proximate to said path for approach of said yarn to the tube, to a takeup position, in which the yarn passage is moved away from the approach path to lengthen a path followed by the yarn, producing takeup of the yarn inside the tube.

2. A device according to claim 1, wherein said yarn takeup element interacts with the actuation means of the injection means for activation or deactivation.

3. A device according to claim 1, wherein said yarn takeup element has a body that is composed of an arc-shaped portion having said yarn passage proximate to said at least one end and is connected, at an opposite end, to an arm arranged radially with respect to said arc-shaped portion, said arm being pivoted to said supporting structure about said axis with an end lying opposite to said arc-shaped portion.

4. A device according to claim 3, wherein said arc-shaped portion has, on the convex side, a channel externally open to accommodate a portion of yarn with the yarn takeup element in said takeup position.

5. A device according to claim 1, wherein said yarn takeup element is arranged between a pair of pins connected to said supporting structure said pins cooperating to form said path for the approach of the yarn to said at least one tube.

6. A device according to claim 3, wherein said supporting structure has a plurality of pins arranged along a curved path and facing the concave side of said arc-shaped portion of the yarn takeup element to keep the yarn adjacent to the takeup element in the takeup position.

7. A device according to claim 3, wherein the center of curvature of said arc-shaped portion of the takeup element is arranged on said axis.

8. A device according to claim 1, further comprising elastic means for contrasting the oscillation of said yarn takeup element in passing from said working position to said takeup position.

9. A device according to claim 1, wherein said means for actuating said injection means comprises a valve arranged along a compressed air supply duct leading into said tube, said valve having a needle shutter element for contact by said yarn takeup element in said takeup position to close the supply duct.

10. A device according to claim 5, wherein said yarn clamping means comprises a presser element cooperating with one of said pair of pins arranged upstream of the yarn takeup element to lock the yarn.

11. A device according to claim 1, further comprising means for actuating said yarn clamping means.

12. A device according to claim 10, wherein the yarn takeup element interferes, in said takeup position, with said presser element to maintain clamping of the yarn when action of the actuation means of the yarn clamping means ceases.

13. A device according to claim 1, wherein said at least one tube comprises a plurality of tubes arranged side by side, each tube being served by a yarn takeup element, said takeup element actuation means comprising first means for collective actuation of the yarn takeup elements for transfer from said working position to said takeup position and second actuation means for performing individual retention of the yarn takeup elements in said takeup position.

14. A device according to claim 13, wherein said first means for collective actuation of the yarn takeup elements comprises a cam device connected to the knitting machine.

15. A device according to claim 13, wherein said second actuation means comprise a plurality of levers, each lever being engageable or disengageable on command with respect to one of the yarn takeup elements for retention in or release from said takeup position.

* * * * *